US005287950A

United States Patent [19]

Feathers et al.

[11] Patent Number: 5,287,950

[45] Date of Patent: Feb. 22, 1994

[54] FALL-ARREST APPARATUS WITH CONSTANT WINCH BRAKING

[75] Inventors: Leonard J. Feathers, Ty Croes; Gerald P. Murphy, Ceunant Llanrug; Ian L. Hartley, Bangor, all of United Kingdom

[73] Assignee: Barrow Hepburn Sala Ltd., Portishead, United Kingdom

[21] Appl. No.: 859,474

[22] PCT Filed: Oct. 30, 1991

[86] PCT No.: PCT/GB91/01901

§ 371 Date: Nov. 17, 1992

§ 102(e) Date: Nov. 17, 1992

[87] PCT Pub. No.: WO92/07626

PCT Pub. Date: May 14, 1992

[30] Foreign Application Priority Data

Oct. 31, 1990 [GB] United Kingdom ..... 9023703

[51] Int. Cl.[5] ..... A62B 35/04

[52] U.S. Cl. ..... 188/83; 188/82.77; 188/187; 192/8 R; 254/376

[58] Field of Search ..... 188/2 A, 30, 65.1, 71.2, 188/72.9, 82.7, 82.74, 82.77, 180, 187–188, 83; 192/7, 8 R, 43.1; 254/376, 357, 321, 310

[56] References Cited

U.S. PATENT DOCUMENTS

| | | | |
|---|---|---|---|
| 1,807,690 | 6/1931 | Ehemann et al. | 188/30 X |
| 2,134,405 | 10/1938 | Hulshizer | 188/82.77 X |
| 2,515,434 | 7/1950 | Zwald | 254/310 X |
| 4,325,522 | 4/1982 | Sauber | 188/83 X |
| 4,456,227 | 6/1984 | Notenboom | 254/357 X |
| 4,489,919 | 12/1984 | Ostrobrod | 254/346 |
| 4,589,523 | 5/1986 | Olson et al. | 182/234 |
| 4,846,313 | 7/1989 | Sharp | 188/187 |

*Primary Examiner*—Robert J. Oberleitner
*Assistant Examiner*—Josie A. Ballato
*Attorney, Agent, or Firm*—Dennison, Meserole, Pollack & Scheiner

[57] ABSTRACT

A fall-arrest apparatus comprises a drum (1) which holds a cable (3) for attachment to a load and has a brake (7–11, 13–15) which automatically stops the drum if it exceeds a certain unwinding speed. The apparatus incorporates a winch mechanism (16–20) by which the drum (1) can be manually turned either to raise or to lower a suspended load. The winch mechanism is associated with a braking device (21) comprising permanently contacting friction braking elements (22,24,25) and a one-way torque coupling (22,28,31–33). That coupling functions between those friction braking elements and the winch handle shaft (17). When the winch mechanism is set for use the one-way torque coupling prevents unwinding motion of the drum (1) otherwise than against the resistance of the permanently contacting friction braking elements.

14 Claims, 3 Drawing Sheets

FALL-ARREST APPARATUS WITH CONSTANT WINCH BRAKING

This invention relates to fall-arrest apparatus for attachment to a fixed anchorage, which apparatus comprises a drum for holding a cable or other extendable anchorage line and a drum brake which functions automatically to brake the drum if it exceeds a given unwinding speed.

Apparatus of this kind have long been used for protecting workers who are exposed to the risk of falling from an elevated work site. Examples of such apparatus are described in UK Patents 851981 and 1552667.

The drum brake employed in apparatus of the kind referred to may be of centrifugal type, comprising braking elements which bodily rotate with the drum. The drum is biased by torsion spring means in the winding direction so as automatically to take up any slack in the anchorage line. The said drum braking elements are normally held retracted by springs but if the drum should reach an unwinding speed above a certain value they move against the action of their springs into positions in which they cause deceleration of the drum to rest.

It is known (see e.g. U.S. Pat. Nos 4,489,919 and 4,846,313) to provide apparatus of the kind referred to with a winch mechanism by which the drum can be manually re-wound to raise a fallen suspended load. The winch handle drives the drum via a reduction gearing affording a substantial mechanical advantage. As the drum begins to be rotated, the centrifugal drum brake mechanism disengages. In order to prevent the load from descending under its own weight as soon as winding force on the winch handle is relaxed, a ratchet operates between the winch handle and the drum housing to prevent any reverse movement of the winch handle. It follows that the winch mechanism cannot be used for lowering a suspended load unless the ratchet is rendered inoperative with consequent risks of the load sustaining an arrested fall due to loss of control of the winch handle by the operator. That is a disadvantage. For example, in the case of the fall of a worker using the fall-arrest apparatus, circumstances may be such that recovery and care of the worker could be more speedily effected if the worker could be lowered to the ground in a controlled manner with complete safety.

U.S. Pat. No. 4,589,523 and European Patent 152041 describe fall-arrest apparatus having a winch mechanism which can be selectively operated in winding or unwinding mode for raising or lowering a fallen load suspended from the anchorage line. This is made possible by a progressively acting screw-type friction clutch incorporated in the transmission between the winch handle and the anchorage line drum. Operation of the winch handle in winding or unwinding mode cause clockwise or anti-clockwise movement of a clutch clamping nut which is in screw engagement with the winch shaft and consequently causes approach or separating movement of friction rings of the clutch. Turning of the winch handle in the winding mode causes the clutch rings to become clamped together so that winding torque is transmitted to the drum, in consequence of which the centrifugal drum brake becomes released. Continued turning of the winch handle in the winding mode causes the load to be winched up. The frictional resistance of the clutch, together with the operation of a pawl and ratchet lock associated with the winch shaft, prevents the drum from unwinding under the suspended load whenever the winding force on the winch handle is relaxed. For lowering the suspended load the winch is operated in either of two ways. In one way, the winch handle is first turned in the winding mode sufficiently to cause release of the centrifugal drum brake as aforesaid and is then turned in the reverse direction until the clamping force on the clutch rings becomes so reduced that the clutch slips under the torque applied by the suspended load. Thereafter a very nice control of the winch handle is necessary if the lowering of the load is to proceed reasonably smoothly. In practice this is difficult. Unwinding motion of the drum in consequence of the clutch slippage tends to tighten the clutch rings again and in practice the anchorage line becomes unwound discontinuously with periods of acceleration followed by periods of gradual deceleration. In the alternative way, of lowering the suspended load, the winch handle is turned in the unwinding mode without first turning it in the opposite direction to release the centrifugal drum brake. But in this case the winch handle has to be turned to release the clamping force on the clutch rings and to bring the clutch clamping nut to the limit of the thread on the winch shaft before the winching-down movement can commence. Once the clamping nut has reached the limit of the thread and cannot therefore be turned further in that direction relative to the winch shaft, continued operation of the winch handle in the unwinding mode drives the anchorage line drum in the unwinding direction via the winch shaft, against the resistance of the main fall-arrest drum brake.

Considerable skill and experience in the operation of the winch of that apparatus is required in order that it can be confidently used to winch down a suspended load in a well controlled manner due to controlled slippage of the winch clutch. Incorrect use of the winch handle can result in rapid fall of the load over a considerable distance before it becomes arrested. The risk is involved in particular when winching down a suspended load of light weight, such for example as a small child. Falls can also occur even when winching-down a load while the drum brake is engaged. Should the descent of the load become interrupted, e.g. due to the load encountering a ledge or other obstruction or to snagging of the anchorage line on a protrusion, so that unwinding torque ceases to be transmitted to the drum via the anchorage line, the drum will start to rewind under the biasing force of the drum spring. Consequently the centrifugal drum brake will become disengaged and when the load or snagged anchorage line is freed from the obstruction, the load will undergo an arrested fall.

The present invention provides apparatus with a winch mechanism by means of which a suspended load can easily be winched up or down in a smooth nicely controlled manner, and without an attendant risk of a potentially damaging fall of the load.

According to the present invention there is provided fall-arrest apparatus for attachment to a fixed anchorage, which apparatus comprises a drum for holding a cable or other extendable anchorage line, a drum brake which functions automatically to brake the drum if it exceeds a given unwinding speed, and a winch mechanism which can be coupled to the drum to permit manual rotation of the drum in winding or unwinding mode for raising or lowering a load suspended from said anchorage line, said winch mechanism having associated braking means for holding a said load against descent under its own weight; characterised in that said winch braking means comprises relatively rotatable brake elements, means which permanently holds such elements in contact under pressure to maintain a predetermined frictional resistance to such relative rotation, and a one-way torque coupling which whenever and for as long as the winch mechanism is coupled to the drum, prevents unwinding motion of the drum otherwise than against the said resistance to relative rotation of said brake elements.

The apparatus affords a high degree of safety by virtue of the permanent effectiveness of the winch brake whenever and for as long as the winch mechanism is in use or is set for use. No particular care or skill is required for operating the winch in either its winding or unwinding mode. The winching-up or winching-down of a load can be safely effected by operating the winch handle at any speed convenient to the operator.

The resistance afforded by the winch brake should of course be sufficient to resist rotation of the drum under the greatest load which may be suspended from the anchorage line during use of the apparatus for its intended purpose. The invention is intended primarily for embodiment in a personnel fall-arrest apparatus. For that field of use, the winch brake should preferably be able to resist rotation of the drum under the torque exerted by a weight in excess of 140 Kg when it is hanging from the anchorage line. Preferably the pulling force which has to be exerted on the anchorage line in order to overcome the resistance of the winch brake is at least 180 Kg.

In the case that the load has been arrested during a fall, and the winch is operated in the unwinding mode while the fall-arrest brake retains its operative condition, the unwinding has to take place against the combined resistances of the drum brake and the winch brake. That combination of resistances can however quite easily be overcome by virtue the fact that the unwinding is actually assisted by the load itself, especially so if the winch mechanism affords a significant mechanical advantage to the winch handle. The said mechanical advantage is preferably in excess of 4:1. if the winch handle is initially operated in the winding mode, just sufficiently to allow the drum brake to disengage, the winching-down will then take place against sole resistance of the winch brake.

The winch brake will also afford the sole braking resistance in the case that the winch is operated for winding down a suspended load which has not undergone an arrested fall causing application of the fall-arrest brake.

Because of the presence of the one-way torque coupling, when the winch is operated in the winding mode for winching up a load, whether or not it has been subject to a fall-arrest, the winch brake does not oppose the winching up operation. However, that brake is effective for holding the load against descent whenever the winding force on the winch handle is relaxed.

Preferably the winch mechanism is arranged so that the operative direction of rotation of the winch handle is clockwise in one transmission mode and anti-clockwise in the other mode. The operation of the winch handle can therefore be according to natural usage.

The apparatus may incorporate supplementary winch brake elements which can be put into effect for holding the drum against rotation in the unwinding mode if the apparatus is used or is intended to be used for carrying exceptionally heavy loads.

A reversible ratchet mechanism may be provided between the winch handle and a driven shaft to permit the drum to be wound or unwound by rocking motion of such handle. A control member conveniently accessible to an operator can be provided for setting this ratchet mechanism for turning the drum clockwise or anticlockwise. The winch brake will effectively hold any suspended load against descent under its own weight whenever and for as long as said ratchet mechanism is in a neutral position.

Certain embodiments of the invention will now be described with reference to the accompanying drawings, in which.

Figure 1:
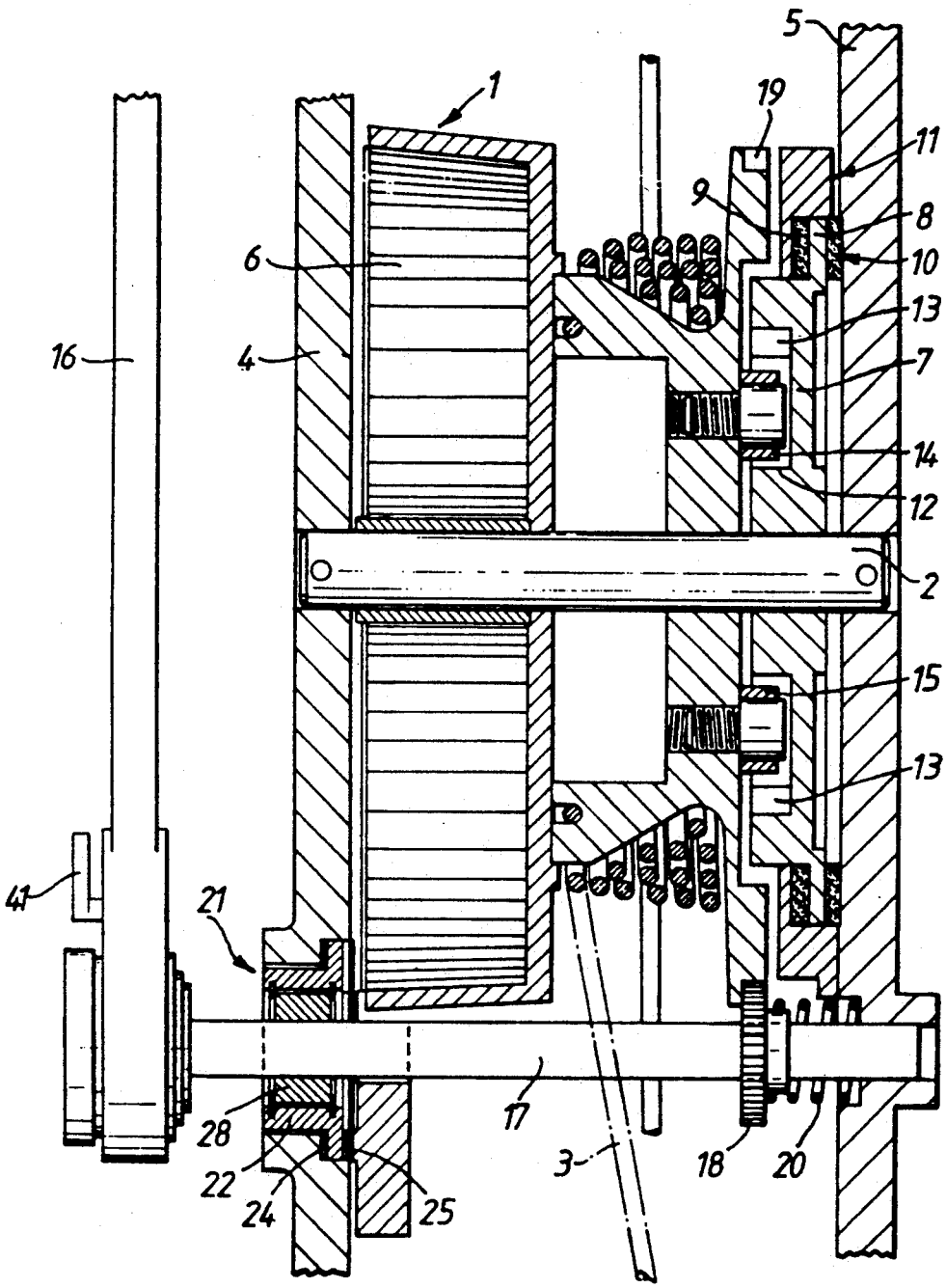
FIG. 1 is a sectional elevation of part of an apparatus according to the invention.
Figure 4:
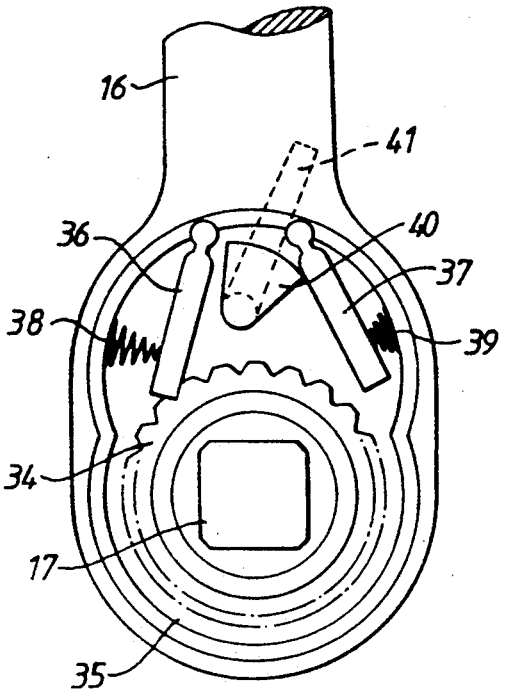
Figure 5:
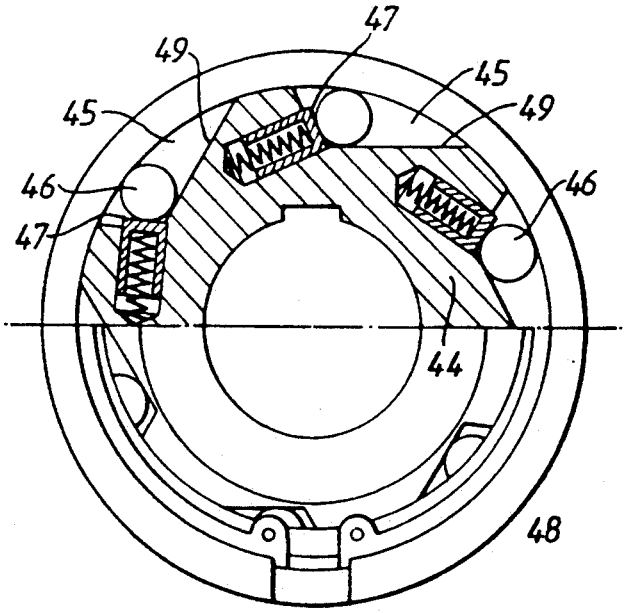
Figure 6:
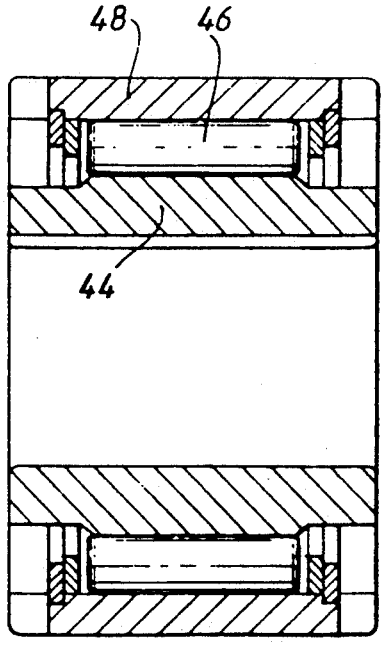

FIG. 4 shows another detail of the winch mechanism of the same apparatus; and FIGS. 5 and 6 are a part sectional front elevation and a sectional side elevation respectively of part of another form of winch braking means As appears in FIG. 1, the apparatus comprises a cable drum 1 which is rotatable on a shaft 2. A cable 3 is wound onto the drum. The shaft 2 is endwise supported in opposed walls 4,5 forming part of an outer casing of the apparatus. The casing can be attached to an elevated fixed anchorage. A spiral spring 6 is connected at one end to that shaft and at the other end to the drum. That spring biases the drum in the winding direction so that when cable which has been pulled out from the apparatus is released, it becomes automatically rewound onto the drum.

There is a fall-arrest drum brake comprising a rotatable brake disc 7 having a perimetral flange 8, and cooperating fixed brake rangs 9,10 between which that flange is sandwiched under pressure exerted by a clamping ring 11. This ring is connected to the casing wall 5 by clamping bolts (not shown). The rotatable disc 7 has an annular recess 12 opening towards the drum. The outer side wall of this recess is shaped to provide a series of ratchet teeth 13. The drum 1 carries pivoted pawls 14,15 for engaging that ratchet. The pawls are normally held out of engagement with the ratchet by springs (not shown) but if, due to a fall of a person attached to the cable 3, the unwinding speed of the drum increases to above a certain value, the pawls pivot into engagement with the ratchet under centrifugal force and torque is thereby transmitted from the drum to the brake disc 7 causing it to rotate against the frictional resistance imposed by the contacting brake rings 9,10. The frictional resistance imposed by the brake decelerates the drum to rest.

The parts of the apparatus so far described are similar in construction and function to parts of apparatus known in the art, e.g. apparatus as described in UK Patent 2192679 and U.S. Pat. No. 4,846,313, and further description of those parts is therefore not necessary.

The illustrated apparatus incorporates an improved winch mechanism which will now be described.

A winch handle 16 is provided by which the drum 1 can be manually rotated for raising or lowering a load, e.g. a person, attached to the cable 3. The winch handle is operable to rotate a winch shaft 17, of square section, which carries a pinion 18. The handle and the shaft 17 are shown in an operative position in which the pinion 18 meshes with a series of teeth 19 formed around the periphery of the right hand side flange of the cable drum 1. When the winch mechanism is thus coupled to the drum, the drum can be turned in either direction by manual operation of the winch handle. The winch mechanism affords a mechanical advantage of 6:1. When the winch mechanism is not required for use it can be rendered inoperative by pushing the winch handle and its shaft 17 towards the right in the aspect of FIG. 1, against the action of a compression spring 20 located between the pinion 18 and the casing wall 5, and securing the handle and shaft in that depressed position by a retaining clamp (not shown) on the casing wall 4. In that inoperative condition of the winch mechanism the pinion 18 is out of meshing engagement with the cable drum.

Figure 3:
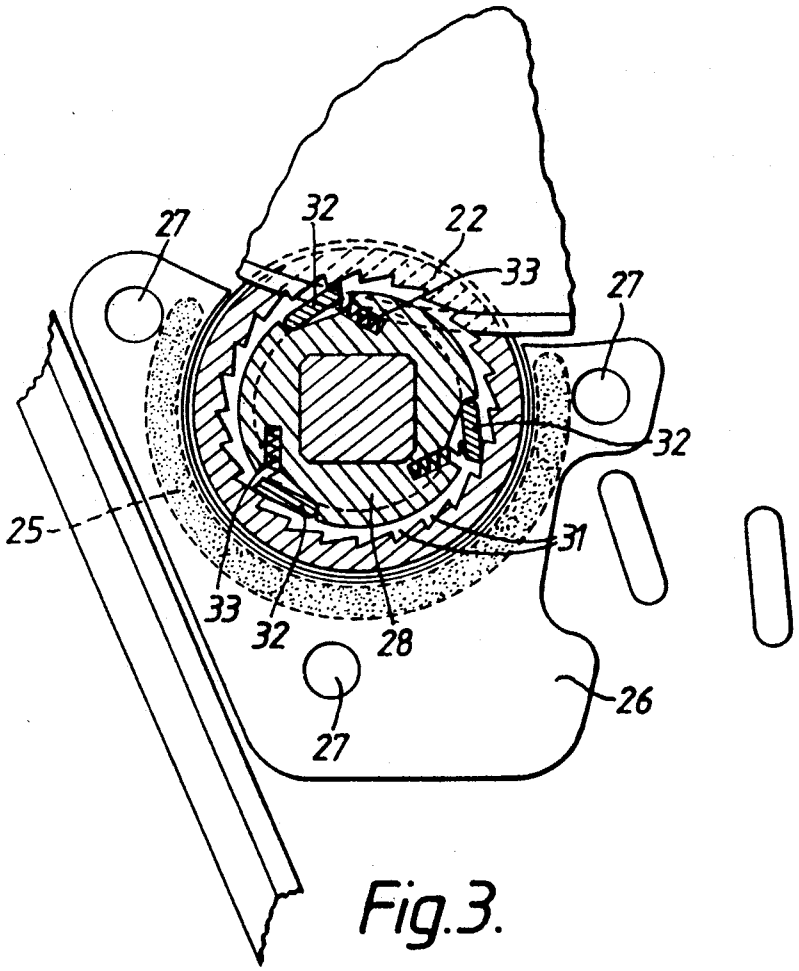
FIG. 3 is a sectional elevation of that braking means, at right angles to FIG. 2.
Figure 2:
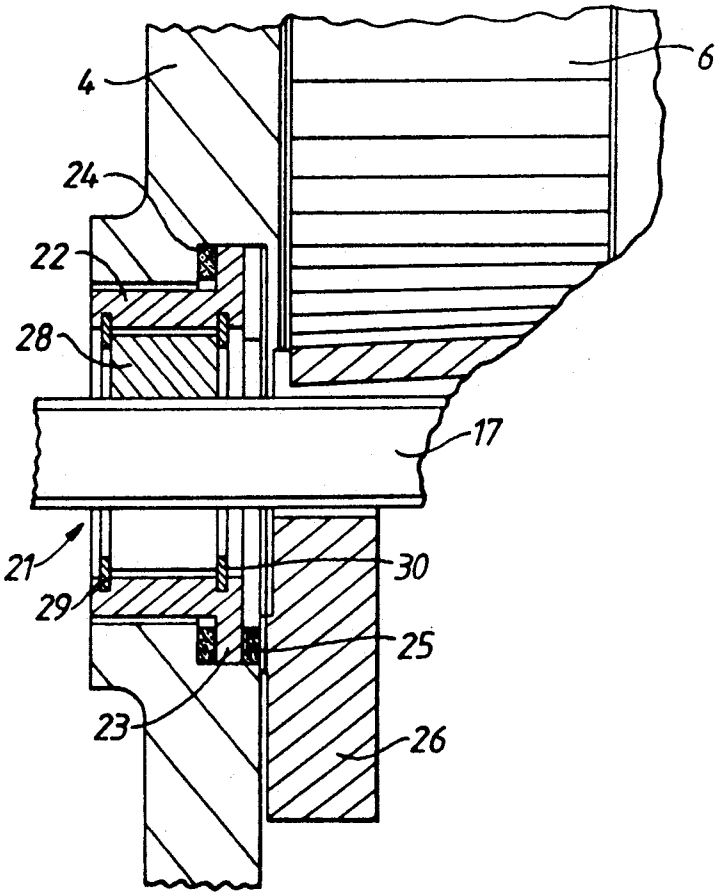
FIG. 2 shows on a larger scale a detail of the braking means associated with the winch mechanism of that apparatus.

The winch mechanism is associated with braking means 21 (FIGS. 1–3). This braking means is formed by cooperating relatively rotatable friction brake elements in combination with a one-way torque coupling between the winch shaft 17 and a tubular component 22 which constitutes one of such brake elements. The component 22 has at one end an external radial flange 23. That flange is located between a friction ring 24 which is seated and secured in a recess on the inner face of the casing wall 4, and an arcuate friction element 25 which is secured to a clamping plate 26. The flange 23, the friction ring 24 and the friction element 25 are held in firm contact by bolts (not shown) which pass through holes 27 in the clamping plate 26 and secure that plate to the side wall 4 of the apparatus casing. Within the component 22 there is a tubular body 28 having a square section bore through which the winch shaft 17 extends with a sliding fit which permits axial movement of the shaft 17 relative to said body. The body 28 is held against axial displacement relative to the surrounding component 22 by retaining rings 29,30 which are seated in grooves in the inner peripheral face of that component 22. The inner face of component 22 also provides a peripheral series of ratchet teeth 31. The body 28 carries three pawls 32 which are angularly spaced around its circumference and are biased into contact with the ratchet teeth 31 by compression springs 33.

The pawls 32 are so orientated and the ratchet teeth 31 are so raked that the ratchet teeth prevent the winch shaft from rotation relative to the friction brake component 22, in the direction which corresponds with unwinding motion of the cable drum. Rotation of the winch shaft in that direction can only take place if the torque exerted on the brake component 22 via the pawl and ratchet coupling is sufficient to overcome the frictional resistance to rotation of that component relative to the cooperating fixed brake elements 23 and 24. The clamping pressure exerted on the friction brake elements 22,24,25 is such that that frictional resistance is sufficient to prevent unwinding motion of the cable drum 1 under the weight of a person who may be suspended from the cable when the apparatus is in service. In a specific example of apparatus as illustrated, the said frictional resistance is sufficient to prevent unwinding motion of the cable drum 1 under the action of a suspended weight of 225 Kg. A person attached to the cable can however be lowered by operating the winch handle. For this purpose, a force is exerted on the winch handle such as to apply to the brake component 22, via the pawl and ratchet coupling, sufficient additional torque to overcome the frictional resistance to the rotation of that component. If the person has fallen, with the result that the fall-arrest brake has operated, that brake continues in operation during the lowering operation because the pawls 14 are retained in engagement with the ratchet teeth 13 by the continued action of the load on the cable. In those circumstances therefore, the winch handle has to be turned against the resistance afforded by the fall-arrest brake and the winch brake but that operation is of course assisted by the weight of the person suspended from the cable.

If the winch handle is turned to a small extent in the winding mode before its operation in the unwinding mode is commenced and sufficiently to free the drum brake pawls 14,15 from their engagement with the ratchet teeth 13, the winching-down operation takes place solely against the resistance of the winch brake.

The person attached to the cable can be raised by operating the winch shaft in the opposite direction by means of the winch handle. If the person has fallen, with the result that the fall-arrest brake has operated, that brake becomes released as soon as the drum starts to turn in the winding direction because the pawls 14 become disengaged from the ratchet teeth 13 and are retracted into inoperative position by the pawl springs. However, at any instant when the winding force applied to the winch handle is relaxed, the winch shaft becomes coupled to the brake component 22 by the pawl and ratchet coupling and the winch brake therefore serves to hold the drum against unwinding movement under the suspended load.

The winch can of course also be operated in the winding or unwinding mode for winching-up or winching-down a load at any time, and not merely after a fall-arrest has occurred.

It will be apparent that when the winch mechanism is operated for raising a load, the force exerted on the winch handle does not have to work against the action of the winch brake because in that direction of rotation of the winch shaft the one-way ratchet coupling does not couple the winch shaft to the friction brake component 22.

Between the ratchet handle 16 and its shaft 17 there is a reversible ratchet coupling. This coupling is shown in FIG. 4. The shaft 17 carries a ratchet ring 34 which is accommodated in a cavity 35 at the base of the handle. Within that cavity there are two pawls 36,37 which are biased by springs 38,39 towards engagement with the ratchet ring. Between these pawls there is a cam 40 which can be positioned to allow one or the other of the pawls to move into operative position under the action of its spring. The cam is movable by a small lever 41 (FIG. 1) which is exposed at the base of the handle for convenient manipulation by the operator. The cam is set in one position or the other depending on whether the handle is to be operated for raising a load or lowering it. Because of the provision of this reversible ratchet a load can be raised or lowered by rocking the winch handle to and fro rather than unidirectionally rotating it through complete revolutions.

FIGS. 5 and 6 show an alternative form of one-way torque coupling which can be employed instead of a pawl and ratchet type torque coupling as shown in FIGS. 1–3. This alternative coupling comprises a tubular body 44 which is formed for splined engagement with a winch shaft. The periphery of this body provides a number of angularly spaced recesses 45 in each of which there is a roller 46. The body 44 houses spring-loaded plungers 47 which keep these rollers resiliently pressed against the inner surface of a surrounding annular component 48. The component 48, like the component 22 in the apparatus according to FIGS. 1-3, constitutes a brake element whose rotation is frictionally resisted by contacting fixed brake elements (not shown). The body 44 is freely rotatable relative to the component 48 in the clockwise direction (in the aspect of FIG. 5). During such rotation the rollers 46 roll or slide along the contacting surface of component 48. However, immediately an anticlockwise turning force is exerted on body 44 the rollers become wedged between that surface and inclined faces 49 of the recesses 45 and anticlockwise movement is thereby prevented.

We claim:

1. Fall-arrest apparatus for attachment to a fixed anchorage, which apparatus comprises a drum (1) for holding a cable or other extendable anchorage line (3), a drum brake (7-11,13-15) which functions automatically to brake the drum (1) if it exceeds a given unwinding speed, and a winch mechanism (16-20) incorporating a handle (16) which can be coupled to the drum to permit manual rotation of the drum in winding or unwinding mode for raising or lowering a load suspended from said anchorage line (3), said winch mechanism having associated braking means (21) for holding said load against descent under its own weight; characterised in that said winch braking means (21) comprises relatively rotatable brake elements (22 or 48,24,25), means (26) which permanently holds such elements in contact under pressure to maintain a predetermined frictional resistance to such relative rotation, and a one-way torque coupling (22,28, 31-33; 44,46,48) which whenever and for as long as the winch mechanism (16-20) is coupled to the drum (1), prevents unwinding motion of the drum otherwise than against the said resistance to relative rotation of said brake elements (22 or 48, 24,25).

2. Apparatus according to claim 1, wherein the resistance to rotation of the drum (1) is such that the pulling force which has to be exerted on the anchorage line (3) in order to overcome that resistance is at least 180 Kg.

3. Apparatus according to claim 2, wherein the winch mechanism (18-20) affords to the winch handle (16) a mechanical advantage in excess of 4:1.

4. Apparatus according to claim 3, wherein a reversible ratchet mechanism (34,36,37) is provided between the winch handle (16) and a driven shaft (17) to permit the drum to be wound or unwound by rocking motion of such handle.

5. Apparatus according to claim 4, wherein said one-way torque coupling comprises roller (46) which whenever the winch handle (16) is operated in the unwinding mode become wedged between a rotatable one (48) of said winch brake elements, and a member (44) driven by the winch handle.

6. Apparatus according to claim 3, wherein said one-way torque coupling comprises rollers (46) which whenever the winch handle (16) is operated in the unwinding mode become wedged between a rotatable one (48) of said winch brake elements, and a member (44) driven by the winch handle.

7. Apparatus according to claim 2, wherein said one-way torque coupling comprises a ratchet ring (22) and cooperating pawls (32).

8. Apparatus according to claim 2, wherein said one-way torque coupling comprises rollers (46) which whenever the winch handle (16) is operated in the unwinding mode become wedged between a rotatable one (48) of said winch brake elements, and a member (44) driven by the winch handle.

9. Apparatus according to claim 1, wherein the winch mechanism (16-20) affords to the winch handle (16) a mechanical advantage in excess of 4:1.

10. Apparatus according to claim 9, wherein said one-way torque coupling comprises rollers (46) which whenever the winch handle (16) is operated in the unwinding mode become wedged between a rotatable one (48) of said winch brake elements, and a member (44) driven by the winch handle.

11. Apparatus according to claim 1, wherein a reversible ratchet mechanism (34,36,37) is provided between the winch handle (16) and a driven shaft (17) to permit the drum to be wound or unwound by rocking motion of such handle.

12. Apparatus according to claim 11, wherein said one-way torque coupling comprises rollers (46) which whenever the winch handle (16) is operated in the unwinding mode become wedged between a rotatable one (48) of said winch brake elements, and a member (44) driven by the winch handle.

13. Apparatus according to claim 1, wherein said one-way torque coupling comprises a ratchet ring (22) and cooperating pawls (32).

14. Apparatus according to claim 1, wherein said one-way torque coupling comprises rollers (46) which whenever the winch handle (16) is operated in the unwinding mode become wedged between a rotatable one (48) of said winch brake elements, and a member (44) driven by the winch handle.

* * * * *

UNITED STATES PATENT AND TRADEMARK OFFICE

CERTIFICATE OF CORRECTION

PATENT NO. : 5,287,950

DATED : February 22, 1994

INVENTOR(S) : Leonard J. Feathers et al

It is certified that error appears in the above-identified patent and that said Letters Patent is hereby corrected as shown below:

Column 7, claim 3, line 45 should read:

--mechanism (16-20) affords to the winch handle (16) a--

Signed and Sealed this

Fourteenth Day of June, 1994

*Attest:*

*Attesting Officer*

BRUCE LEHMAN

*Commissioner of Patents and Trademarks*